US007111675B2

(12) United States Patent
Zisk, Jr.

(10) Patent No.: US 7,111,675 B2
(45) Date of Patent: Sep. 26, 2006

(54) REMOTE CLOSED SYSTEM HYDRAULIC ACTUATOR SYSTEM

(75) Inventor: Edward J. Zisk, Jr., Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 421 days.

(21) Appl. No.: 10/218,384

(22) Filed: Aug. 14, 2002

(65) Prior Publication Data

US 2003/0034899 A1 Feb. 20, 2003

Related U.S. Application Data

(60) Provisional application No. 60/313,537, filed on Aug. 20, 2001.

(51) Int. Cl.
*E21B 43/00* (2006.01)
*F04B 17/00* (2006.01)

(52) U.S. Cl. ..... 166/65.1; 166/66; 417/413.1; 310/311

(58) Field of Classification Search ..... 340/853.1, 340/853.3, 854.4, 854.5; 166/66–67, 250, 166/53, 57, 65.1; 175/40; 417/410.1, 413.1, 417/413.2; 310/311
See application file for complete search history.

(56) References Cited

U.S. PATENT DOCUMENTS 3,990,512 A * 11/1976 Kuris ..... 166/249
4,449,893 A 5/1984 Beckman et al.
4,795,318 A 1/1989 Cusack
5,291,182 A * 3/1994 Wiseman ..... 340/610
5,323,855 A * 6/1994 Evans ..... 166/248
5,448,227 A * 9/1995 Orban et al. ..... 340/854.4
5,676,213 A * 10/1997 Auzerais et al. ..... 175/58
5,934,371 A 8/1999 Bussear et al. ..... 166/53
6,167,965 B1 * 1/2001 Bearden et al. ..... 166/250.15
6,216,779 B1 4/2001 Reinhardt ..... 166/57
6,321,845 B1 11/2001 Deaton

OTHER PUBLICATIONS

PCT International Search Report.
Christopher S. Lynch, Development of a Piezoelectric Driven Hydraulic Pump/Actuator System For use in Oil Well Tools, Mar. 20, 2000.

* cited by examiner

*Primary Examiner*—Jeffery Hofsass
*Assistant Examiner*—Kimberly Jenkins
(74) *Attorney, Agent, or Firm*—Cantor Colburn LLP

(57) ABSTRACT

A hydraulic actuator system includes a power source, a controller in communication with the power source, a piezoelectric stack comprising a plurality of piezoelectric elements disposed within a sleeve to define a chamber at one end of the sleeve, pressure accumulators in fluid communication with the chamber, a flow control valve in communication with the accumulators, and a hydraulic piston in fluid communication with the flow control valve. The communication between the power source and the controller may be electrical or photo communication, and the power source is preferably remotely located relative to the other elements of the hydraulic actuator system. The method for controlling a remotely located hydraulic actuator includes communicating a signal to the hydraulic actuator, pressurizing a hydraulic fluid in the hydraulic actuator, and directing the hydraulic fluid to a cylinder in the hydraulic actuator to bias a piston either into or away from the cylinder.

39 Claims, 7 Drawing Sheets

REMOTE CLOSED SYSTEM HYDRAULIC ACTUATOR SYSTEM

CROSS REFERENCE TO RELATED APPLICATIONS

This application claims the benefit of an earlier filing date from U.S. Provisional Application Serial No. 60/313,537 filed Aug. 20, 2001, the entire disclosure of which is incorporated herein by reference.

BACKGROUND

1. Technical Field

This disclosure relates to actuating systems, and, more particularly, to an apparatus and method for actuating a remotely locatable hydraulic mechanism with pressurized fluid.

2. Related Art

Valve actuating systems of the related art are typically hydraulically controlled mechanisms (HCMs) requiring the running of hydraulic control lines from a hydraulic fluid source to a valve actuator. The hydraulic fluid source is generally a supply tank of sufficient volume to accommodate the amount of hydraulic fluid required for the HCM with some amount of fluid in reserve. The hydraulic fluid is typically supplied to the valve actuating system through an arrangement of two control lines, which, depending upon the location of the valve actuator relative to the hydraulic fluid source, may necessitate a configuration of equipment that may be complex and expensive, especially in oilfield applications where the valve to be actuated is located downhole in a wellbore.

The hydraulic fluid supply tank is typically sized to accommodate two or three times the amount of hydraulic fluid required for normal operation of the HCM and is generally located at a well head of the wellbore. Because the volume of the supply tank is a function of the amount of the hydraulic fluid required for use in the system, an HCM remotely positioned relative to the well head could require a surface-located supply tank of a very large volume. In particular, a valve located downhole in a wellbore may be positioned at a depth such that miles of control line are required to actuate the valve. As the length of the control line is increased, the volume of hydraulic fluid required to maintain hydraulic pressure within the system correspondingly increases.

The control lines themselves occupy space within either the casing or the tubing string such that their presence detracts from the usable volume of the downhole environment. Because the control lines are conduits for fluids, they are typically of considerable size relative to electrical wiring or fiber optic cable. Furthermore, two control lines are typically required for each HCM. In an effort to minimize the number of control lines in the wellbore, one control line is usually run to each HCM and a common control line is shared by all of the HCMs. Nevertheless, operation of an oil well with multiple HCMs provides a challenge to surface-located operators because of the multiple connections involved and the possibility that control lines may cross each other within the wellbore and provide a source for fluid communication problems between the hydraulic fluid supply tank and the downhole environment.

SUMMARY

A hydraulic actuator, a hydraulic actuator system, and a method for controlling a remotely located hydraulic actuator are disclosed herein. The hydraulic actuator is configured to be incorporable into the downhole environment of a wellbore and includes a hydraulic fluid pump reservoir, a piezoelectric pump in fluid communication with the fluid pump reservoir, and a hydraulically operable device in operable communication with the piezoelectric pump. The hydraulic actuator system is also configured to be incorporable into the wellbore and includes a power source, a controller remotely located from and in communication with the power source, and a piezoelectric stack in electrical communication with the controller. The piezoelectric stack includes a sleeve and a plurality of piezoelectric elements disposed therein configured to define a chamber at one end of the sleeve having a volume that is a function of the expansion of the piezoelectric elements. The chamber is in fluid communication with a high pressure environment and a low pressure source, which may be an accumulator, a hydraulic control line, or the downhole environment itself. The high pressure environment and the low pressure source are each in fluid communication with a hydraulic piston through a flow directional valve. Different types of power, which may be electrical, optical, or some other type of power, may be used to drive the piezoelectric pump. Inlet and outlet check valves in the chamber permit fluid flow to or from the hydraulic piston. The flow directional valve is controllable and configured to provide communication between the high pressure environment and the hydraulic piston to effectuate a movement of the hydraulic piston in either a first or second direction. The hydraulically actuatable device may be either a hydraulic piston, a rotary actuatable device, or a similar device. The power source is located at a well head of a wellbore and the controller, the piezoelectric stack, the accumulator, the flow directional valve, and the hydraulic piston are located in a downhole environment of the wellbore.

The method of using the hydraulic actuator system entails communicating a signal from the power source to the hydraulic actuator, pressurizing the hydraulic fluid in the hydraulic actuator, and directing the hydraulic fluid to the cylinder in order to bias the hydraulic piston. Communication of the signal from the power source to the hydraulic actuator typically involves transmitting the signal to the controller through either an electrical or a photo communication medium to effectuate the pressurization and direction of the hydraulic fluid. The pressurization includes expanding the piezoelectric element, decreasing the volume of the chamber in which the hydraulic fluid is disposed, and creating a high pressure condition within the chamber, thereby causing the hydraulic fluid to flow out of the chamber. In a preferred embodiment, the power source is remotely located relative to the hydraulic actuator.

The remotely locatable hydraulic actuator system, which may employ more than one hydraulic actuator, effectively eliminates the need for surface-located hydraulic fluid tanks and either eliminates or reduces the need for hydraulic control lines characteristic of hydraulic control mechanisms (HCMs) of the related art. Because the surface hydraulic fluid tanks can be eliminated and because all or most of the hydraulic control lines are replaced with either electrical or optical fiber cable, significant space savings within a wellbore can be realized. Furthermore, the remotely locatable actuator system allows for the simplified installation of HCMs in downhole environments below the sea floor. These benefits, viz., the reduction in the amount of space required for oil drilling operations and the simplification of the installation of equipment in the wellbore, ultimately result in a cost savings associated with the maintenance and operation of a wellbore. Additional benefits may be derived from the increased reliability of the system due to fewer control lines and hydraulic line connections.

BRIEF DESCRIPTION OF THE DRAWINGS

Referring to the drawings wherein like elements are numbered alike in the several FIGURES.

DETAILED DESCRIPTION

Figure 1:
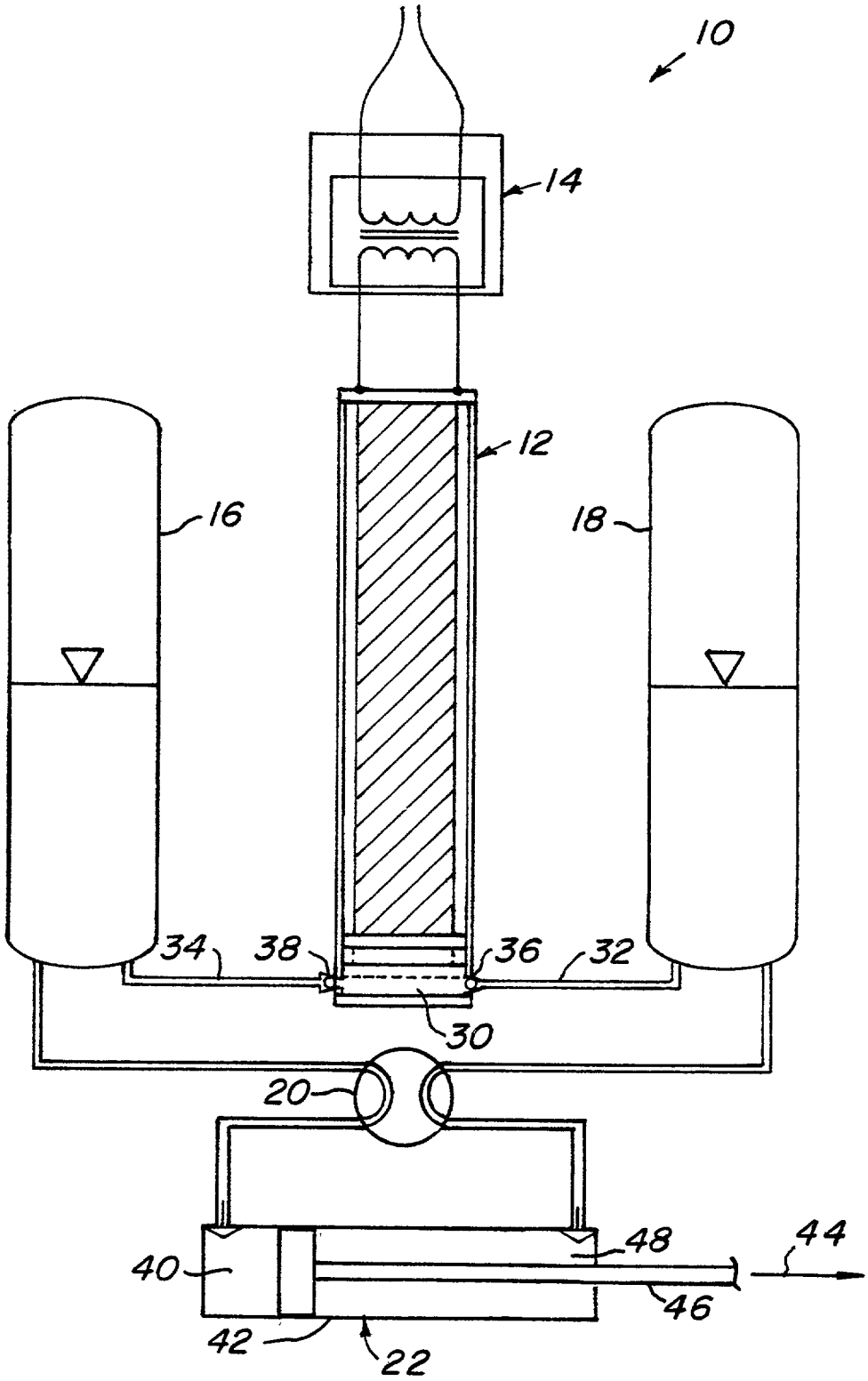
FIG. 1 is a schematic drawing of a remotely locatable hydraulic actuator system wherein a hydraulic piston thereof is in a non-extended position.

Referring to FIG. 1, a remotely locatable hydraulic actuator system is shown generally at 10 and is hereinafter referred to as "system 10". System 10 comprises a piezoelectric stack, shown generally at 12, an actuator controller/power conditioning element, shown generally at 14, a flow control valve 20, which is typically a three-way valve, and an actuation device, which is typically a hydraulic piston, shown generally at 22. System 10 may also include high and low pressure accumulator elements, shown at 16 and 18 respectively to provide high and low pressure sources to facilitate the operation of system 10. The foregoing components of system 10 are arranged and configured such that piezoelectric expansion of piezoelectric stack 12 causes a pressure differential, which may occur across accumulator elements 16, 18, that drives hydraulic piston 22. Piezoelectric expansion of piezoelectric stack 12 is typically effectuated by electric power from a remote source, although other power forms (e.g., photovoltaic, as described below with reference to FIG. 9) may be utilized. Hydraulic piston 22 is operably connected to and configured to actuate a valve (not shown) in a downhole environment of a wellbore (not shown). Other uses of system 10 include, but are not limited to, the driving of pumping devices, the actuation of electrical relays, the control of downhole safety valves, inflation of downhole packers, pumping of downhole chemical injection fluids, and the actuation of valve-closure members of water and chemical injection systems.

Figure 2:
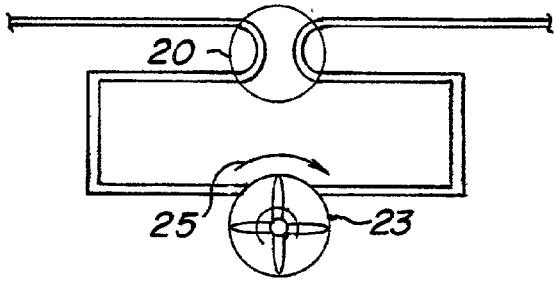
FIGS. 2 and 3 are schematic drawings of a rotary actuatable device and a control valve configured to permit fluid flow in first and second directions respectively.
Figure 3:
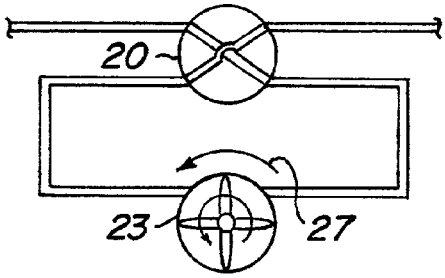

As shown in FIGS. 2 and 3, the actuator device may be a rotary actuatable device 23. Rotary actuatable device 23 may be responsive to pressure gradients in either direction as a result of the articulation of flow control valve 20. As shown in FIG. 2, articulating flow control valve 20 to be in the configuration shown rotates rotary actuatable device 23 in the direction of an arrow 25. Articulating flow control valve 20 in the configuration as shown in FIG. 3 results in the rotation of rotary actuatable device 23 in the direction of an arrow 27. Alternately, rotary actuatable device 23 may be configured to respond to a pressure gradient in a single direction only, as described below with reference to FIG. 8.

Figure 4:
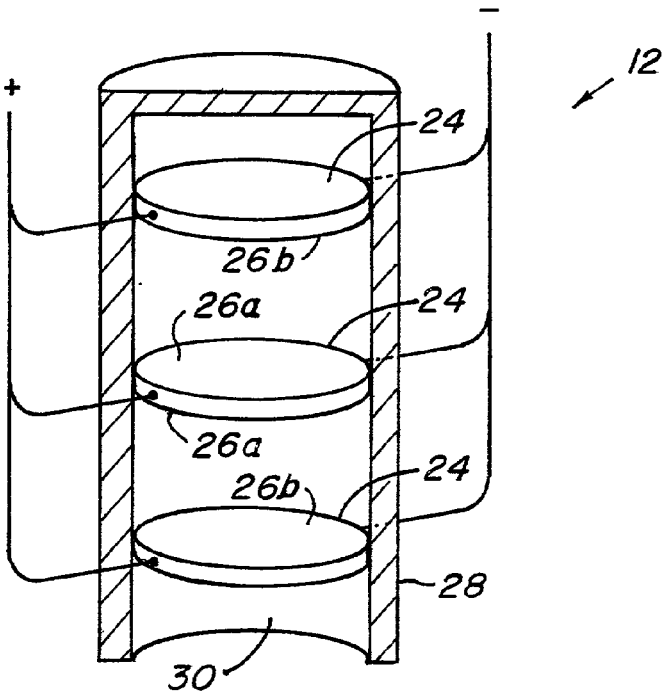
FIG. 4 is a perspective and partially cutaway drawing of the piezoelectric stack showing an exploded view of the positioning of piezoelectric elements.

Referring now to FIG. 4, piezoelectric stack 12 is shown in greater detail. Piezoelectric stack 12 comprises a series of monolithic piezoelectric elements 24 that are preferably plate-like in structure and disposed within a sleeve 28. Each piezoelectric element 24 is arranged such that opposing flat planar faces 26*a* thereof contact adjacent flat planar faces 26*b* of adjacently positioned piezoelectric elements 24. Piezoelectric elements 24 are disposed within sleeve 28 such that a piston chamber 30 is defined at one end thereof.

Each piezoelectric element 24 is a piezoelectric transistor (PZT) and is preferably fabricated of lead zirconate titanate. Other materials from which piezoelectric element 24 may be fabricated include, but are not limited to, quartz ($SiO_2$), tourmaline, barium titanate ($BaTiO_3$), and various other barium and titanium salts. Organic and metallic tartrate salts, and particularly sodium potassium tartrate ($NaKC_4H_4O_6$), may also be utilized.

Piezoelectric stack 12 is actuated by the application of an electric potential thereacross. The application of a voltage across each individual piezoelectric element 24 results in the structural deformation of the piezoelectric element 24, the greatest degree of deformation being in a longitudinal direction that is normal to the direction of the applied voltage field. The resulting longitudinal deformation, or strain, induced in the direction normal to the applied voltage field is typically on the order of about one percent. As a result of this strain, actuator controller/power conditioner 14 is incorporated to provide a voltage as a step function signal to actuate piezoelectric elements 24 with a very high frequency to attain the required flow rate of hydraulic fluid within the system.

Referring back to FIG. 1, the effect of the operation of piezoelectric stack 12 on system 10 is described. The longitudinal expansion of piezoelectric elements 24 effectuates the reduction in volume of piston chamber 30, which is in communication with an inlet 32 and an outlet 34 of piezoelectric stack 12. Inlet 32 includes an inlet check valve 36 configured to permit the flow of a hydraulic fluid (not shown) into piston chamber 30 from a low pressure source such as low pressure accumulator 18 while preventing the flow of hydraulic fluid out of piston chamber 30 to the low pressure source. Outlet 34, in contrast, incorporates an outlet check valve 38 that permits the flow of the hydraulic fluid out of piston chamber 30 while preventing its backflow into piston chamber 30 from the high pressure environment. The high pressure environment may be high pressure accumulator 16, as shown. Alternately, the high pressure environment may simply comprise the piping extending between outlet check valve 38 and flow control valve 20. A reduction in the volume of piston chamber 30 due to the longitudinal deformation of piezoelectric stack 12 creates a positive pressure in piston chamber 30 and forces the hydraulic fluid through outlet check valve 38. Subsequent contraction of piezoelectric stack 12, whether caused by removal of the applied voltage or by reversal of the polarity of the applied voltage, necessitates the formation of a low pressure condition or vacuum within piston chamber 30. This low pressure condition or vacuum enables inlet check valve 36 to release, thereby filling piston chamber 30 with hydraulic fluid from the low pressure source.

Hydraulic fluid expelled from piston chamber 30 through outlet check valve 38 is received by the high pressure environment. When flow control valve 20 is in an "open" or "extend" position and when the high pressure environment is high pressure accumulator 16, fluid communication is maintained between a piston side 40 of a cylinder 42 housing hydraulic piston and high pressure accumulator 16. Flow control valve 20 thereby controllably permits the escape of the hydraulic fluid from high pressure accumulator 16, as shown in FIG. 1 to effectuate the motion of hydraulic piston 22. By "opening" flow control valve 20 such that it is in the "extend" position, the high pressure condition maintained in high pressure accumulator 16 is relieved, and the hydraulic fluid moves under some head through flow control valve 20 to piston side 40 of cylinder 42, where it forces hydraulic piston 22 to translate the length of cylinder 42 in the direction of an arrow 44, thereby moving a rod 46 connected to hydraulic piston 22 to correspondingly translate the length of cylinder 42. Hydraulic fluid on a rod side 48 of cylinder 42 is simultaneously forced into the low pressure source, which may comprise low pressure accumulator 18. In a preferred embodiment, rod 46 is connected to the valve to be actuated, which is located downhole in a wellbore, and the translation of rod 46 causes the valve to either open or close.

Figure 5:
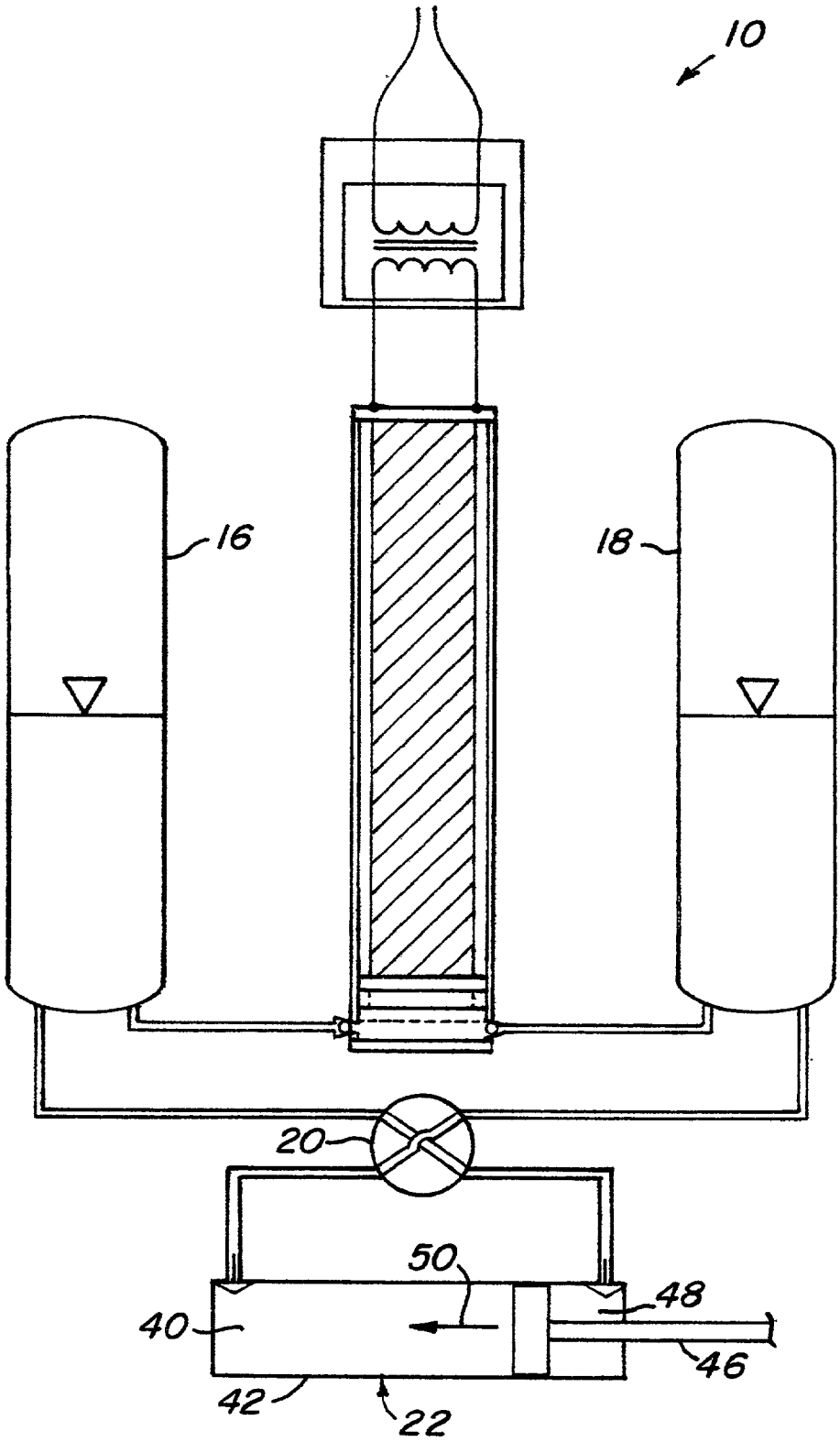
FIG. 5 is a schematic drawing of a remotely locatable hydraulic actuator system wherein the hydraulic piston thereof is in an extended position.

Referring now to FIG. 5, translation of hydraulic piston 22 of system 10 to actuate the valve into the other position is illustrated. By manipulating flow control valve 20 to be in a "closed" position, fluid communication is maintained between rod side 48 of hydraulic piston 22 and high pressure accumulator 16. As such, application of a voltage across piezoelectric stack 12 causes deformation thereof, which in turn effectuates the repressurization of high pressure accumulator 16. Once the proper pressure is attained in high pressure accumulator 16, the hydraulic fluid therein moves under some head through flow control valve 20 to rod side 48 of cylinder 42, where it forces hydraulic piston 22 to translate the length of cylinder 42 in the direction of an arrow 50, thereby translating rod 46 correspondingly and forcing the hydraulic fluid on piston side 40 of cylinder 42 into low pressure accumulator 18. Translation of rod 46 in the direction of arrow 50 causes the valve to perform the opposite operation the valve engaged in when rod 46 translated cylinder 42 in the direction of arrow 44, as was shown in FIG. 1.

Figure 6:
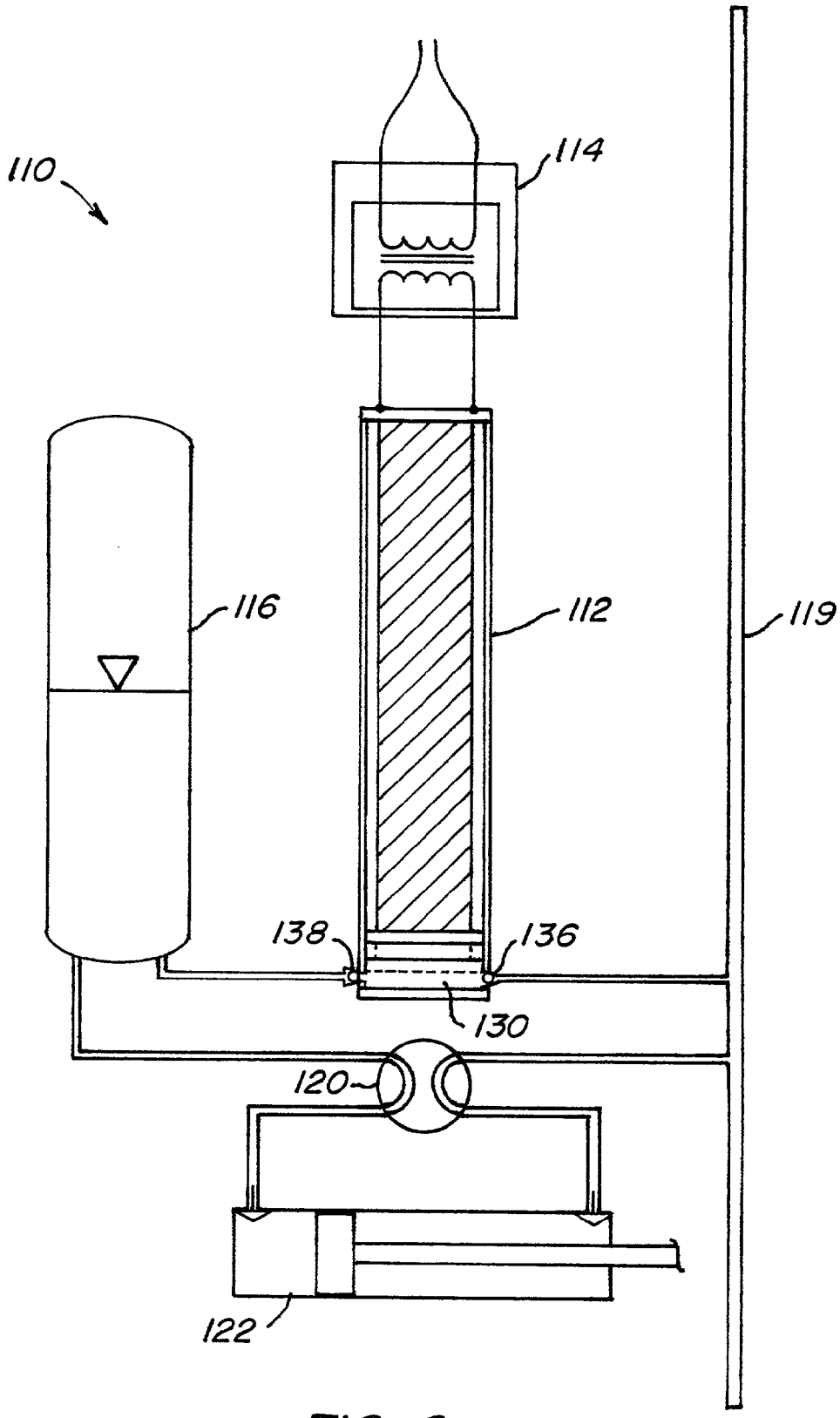
FIG. 6 is a schematic drawing of an alternate embodiment of a remotely locatable hydraulic actuator system wherein the system is in fluid communication with a hydraulic control line.

Referring to FIG. 6, an alternate embodiment of a remotely locatable hydraulic actuator system is shown generally at 110 and hereinafter is referred to as "system 110". System 110 is incorporable into a wellbore (not shown) and comprises a piezoelectric stack 112, a single high pressure accumulator element 116 in fluid communication with a piston chamber 130 through an outlet check valve 138, and a low pressure source, such as a hydraulic supply line 119, in communication with piston chamber 130 through an inlet check valve 136. Piezoelectric stack 112 is positioned adjacent to piston chamber 130 and is controllable by an actuator controller/power conditioning element 114. Hydraulic supply line 119 extends from system 110 to a hydraulic fluid source (not shown) remotely located from system 110, which is typically positioned at or near the well head. A flow control valve 120 is configured to control the flow of hydraulic fluid between high pressure accumulator element 116, a hydraulic piston 122, and hydraulic control line 119. Hydraulic piston 122 is operably connected to and configured to actuate a valve (not shown) in the downhole environment of the wellbore.

The operation of system 110 is similar to the operation of system 10 as shown in FIG. 1; however, whether flow control valve 120 is in an "open" position (as shown) or when it is "closed" (not shown), hydraulic fluid is forced into or drawn from hydraulic supply line 119 instead of being forced into or drawn from the low pressure accumulator element of the system as shown in FIG. 1.

Figure 7:
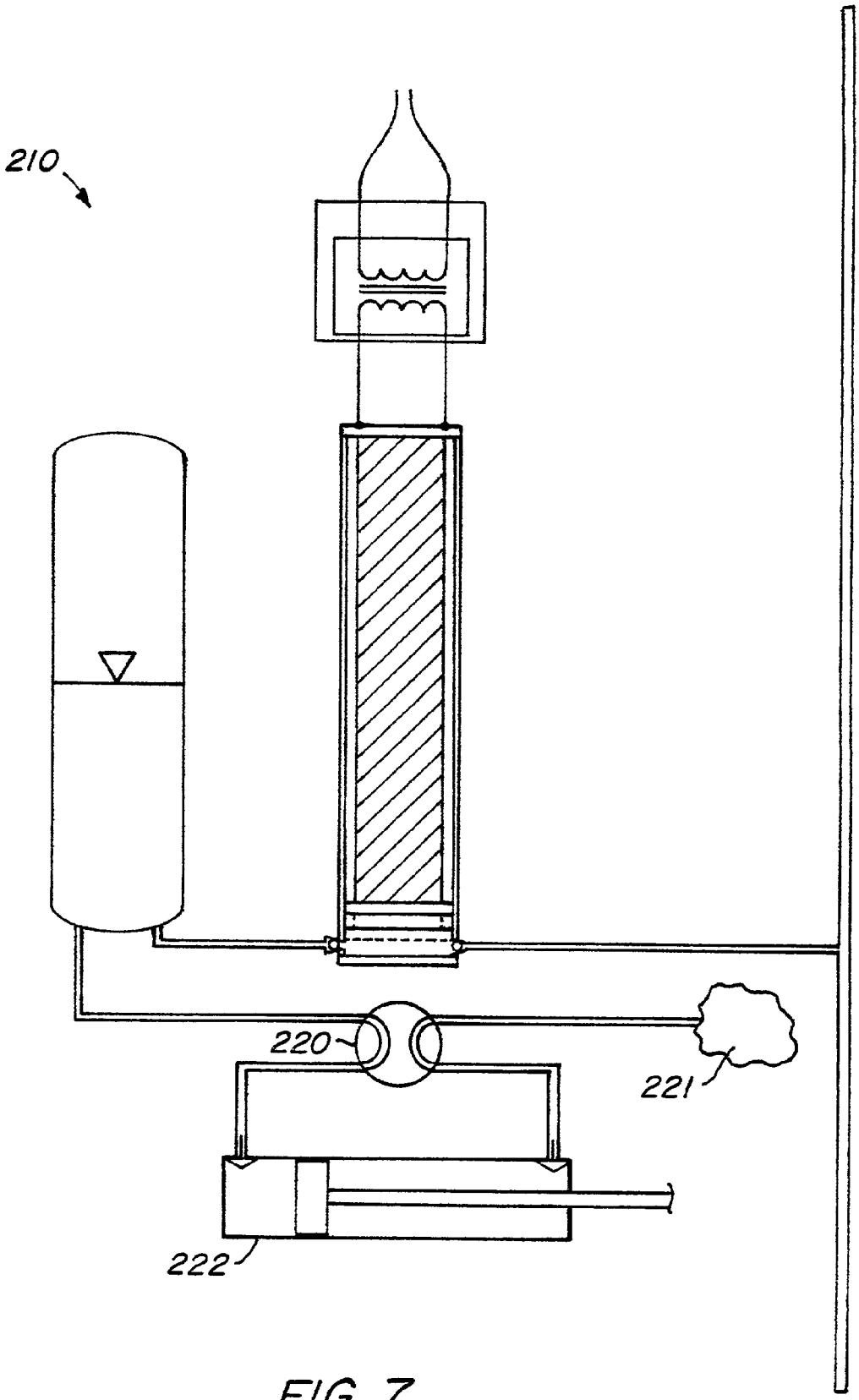
FIG. 7 is a schematic drawing of an alternate embodiment of a remotely locatable hydraulic actuator system wherein the system is in fluid communication with either a tubing string of a wellbore or an annulus of the wellbore.

In another alternate embodiment, as shown in FIG. 7, a remotely locatable hydraulic actuator system is shown generally at 210 and is hereinafter referred to as "system 210". System 210 is similar in configuration to the system of FIG. 6, and differs in that a flow control valve 220 is configured to control the flow of hydraulic fluid (not shown) between a high pressure accumulator element 216, a hydraulic piston 222, and a downhole environment 221 of a wellbore, which may be either the tubing string positioned within the wellbore or the annulus defined thereby. In such an embodiment, upon operation of hydraulic piston 222 to actuate a valve (not shown) in the downhole environment of the wellbore, hydraulic fluid is forced into either the annulus or the tubing string.

Figure 8:
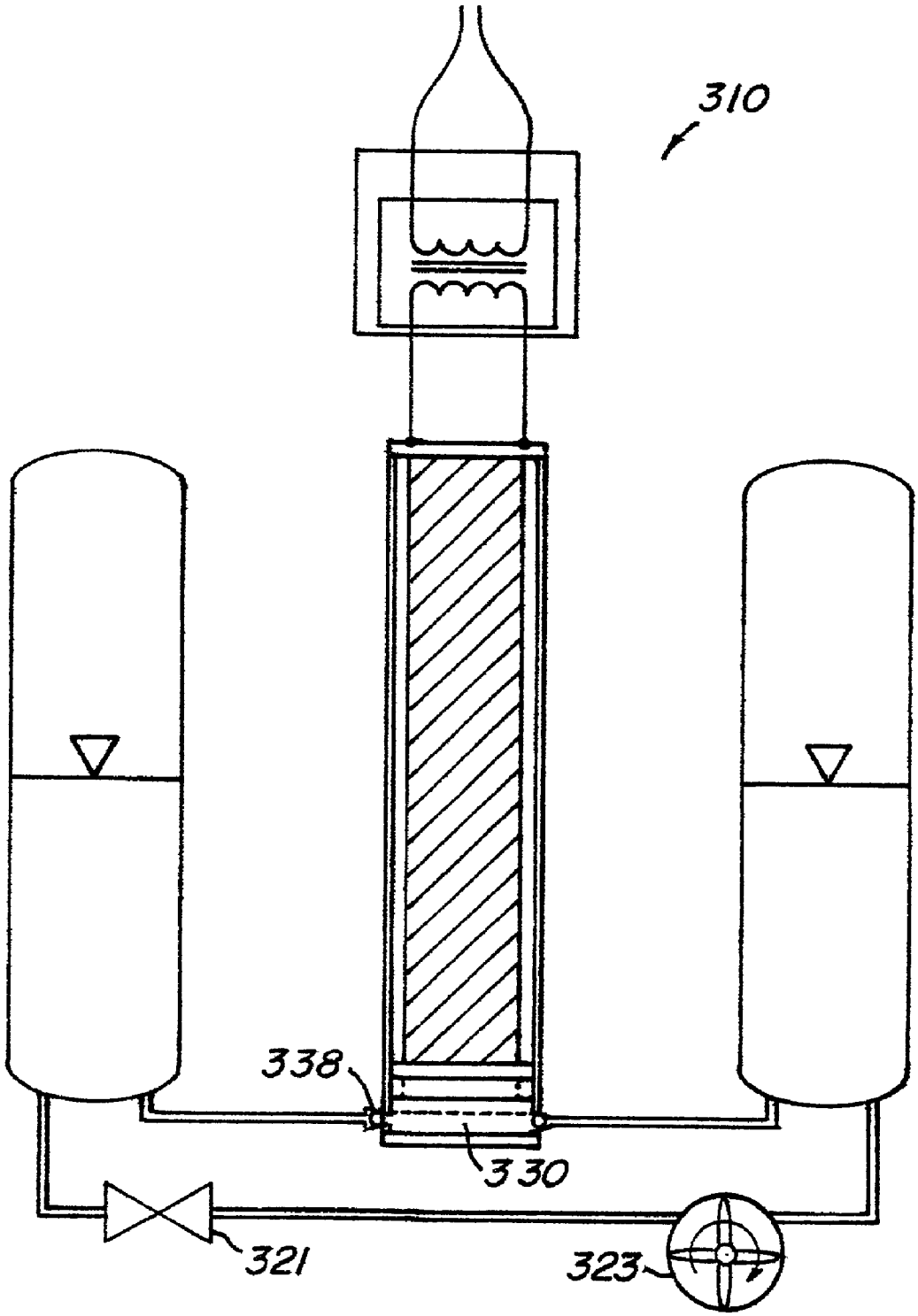
FIG. 8 is a schematic drawing of an alternate embodiment of a remotely locatable hydraulic actuator system wherein the flow of hydraulic fluid is in one direction throughout the operation thereof.

In still another embodiment, as shown in FIG. 8, another alternate embodiment of a remotely locatable hydraulic actuator system is shown generally at 310 and is hereinafter referred to as "system 310". System 310 is incorporable into a wellbore and is similar to the above-defined systems. In system 310, however, an outlet check valve 338 is in fluid communication with a flow control valve 321, across a high pressure environment. The high pressure environment is may include a high pressure accumulator 316. Flow control valve 321, which is typically either a globe valve or a gate valve, controls the flow of hydraulic fluid from a piston chamber 330 to a one-way rotary actuatable device 323 that may be a valve, a pumping device, or a similar device.

Figure 9:
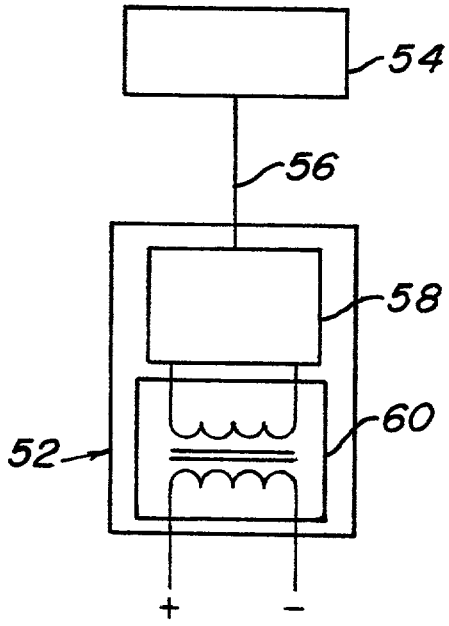
FIG. 9 is a schematic drawing of an alternate embodiment of an actuator controller/power conditioner powered by a photovoltaic cell.

Referring now to FIG. 9, any one of the embodiments of the remotely locatable hydraulic actuator system can be made operable using a photovoltaic cell shown generally at 52. In such an embodiment, photovoltaic cell 52 is typically driven by a power source 54 through a communication medium 56 and amplified using a voltage amplifier 58. Power source 54 may be any suitable light source including, but not limited to, a laser. Communication medium 56 may be any medium compatible with power source 54 including, but not limited to, fiber optic cable. Power source 54, as in the preferred embodiment, is in electrical communication with a transformer and a circuit controller 60 that supplies an alternating voltage to a piezoelectric stack.

Figure 10:
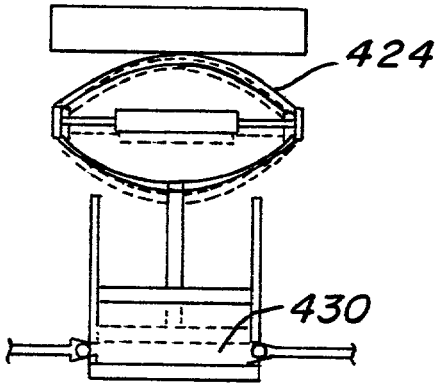
FIG. 10 is a schematic drawing of an alternate embodiment of a piezoelectric stack in which a piezoelectric element is of a prolate spheroid shape.

In another embodiment, as shown in FIG. 10, a piezoelectric element 424 may be configured to have a prolate spheroid shape. Such a shape amplifies the linear movement of a piezoelectric stack allowing a smaller PZT to provide the same stroke movement. By fabricating each piezoelectric element 424 from less PZT material and maintaining an amount of deformation of each piezoelectric element 424 that meets or exceeds the amount of deformation of plate-shaped piezoelectric elements 24 illustrated in FIGS. 1, 4, and 5, a reduction in volume of a piston chamber 430 can result in improved packaging configuration. Piezoelectric element 424 is typically used in conjunction with the same configuration of the remotely locatable hydraulic actuator system as shown in FIGS. 1, 5, 6 and 7.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A hydraulic actuator, comprising:

a hydraulic fluid reservoir locatable in a downhole environment of a wellbore;

a piezoelectric pump connected to said hydraulic fluid reservoir; and a hydraulically operable device connected to said piezoelectric pump.

2. The hydraulic actuator of claim 1 wherein said piezoelectric pump is in communication with a power source.

3. The hydraulic actuator of claim 2 wherein said communication between said piezoelectric pump and said power source is electrical communication.

4. The hydraulic actuator of claim 2 wherein said communication between said piezoelectric pump and said power source is photo communication.

5. The hydraulic actuator of claim 4 wherein said photo communication is through a fiber optic cable.

6. A hydraulic actuator system, comprising:

a power source;

a controller remotely located from and in communication with said power source;

and at least the following in a downhole location, a piezoelectric stack in electrical communication with said controller, said piezoelectric stack comprising, a sleeve, and a plurality of piezoelectric elements disposed within said sleeve and being configured to define a chamber receptive to hydraulic fluid at an end of said sleeve, the volume of said chamber being a function of expansion of said piezoelectric elements;

a flow control valve in fluid communication with said chamber; and a hydraulically actuatable device in fluid communication with said flow control valve.

7. The hydraulic actuator system of claim 6 wherein said hydraulically actuatable device comprises, a high pressure environment in fluid communication with said chamber, and a low pressure source in fluid communication with said chamber, and wherein said flow control valve is in fluid communication with said high pressure environment and said low pressure source.

8. The hydraulic actuator system of claim 6 wherein said communication between said power source and said controller is electrical communication.

9. The hydraulic actuator system of claim 6 wherein said communication between said power source and said controller is photo communication.

10. The hydraulic actuator system of claim 9 wherein said photo communication is through a fiber optic cable.

11. The hydraulic actuator system of claim 6 wherein said piezoelectric stack further comprises, an inlet check valve disposed between said chamber and said hydraulically actuatable device to permit fluid flow into said chamber from said hydraulically actuatable device, and an outlet check valve disposed between said chamber and said hydraulically actuatable device to permit fluid flow out of said chamber and into said hydraulically actuatable device.

12. The hydraulic actuator system of claim 6 wherein said flow control valve is controllable and configured to provide communication between said chamber and said hydraulically actuatable device to effectuate a movement of said hydraulically actuatable device.

13. The hydraulic actuator system of claim 12 wherein said hydraulically actuatable device is a hydraulic piston.

14. The hydraulic actuator system of claim 12 wherein said hydraulically actuatable device is a rotary actuatable device.

15. The hydraulic actuator system of claim 6 wherein each of said piezoelectric elements is of a prolate spheroid shape.

16. The hydraulic actuator system of claim 6 wherein said plurality of piezoelectric elements includes at least one piezoelectric element having a plate shape and at least one piezoelectric element having a prolate spheroid shape.

17. The hydraulic actuator system of claim 6 wherein each of said piezoelectric elements is fabricated from a material selected from the group consisting of lead zirconate titanate, barium titanate, quartz, tourmaline, and tartrate salts.

18. The hydraulic actuator system of claim 6 wherein said power source is located at a well head of a wellbore and wherein said controller, said piezoelectric stack, said flow control valve, and said hydraulically actuatable device are located in a downhole environment of said wellbore.

19. The hydraulic actuator system of claim 7 wherein said low pressure source is a low pressure accumulator.

20. The hydraulic actuator system of claim 7 wherein said low pressure source is a hydraulic control line.

21. The hydraulic actuator system of claim 7 wherein said low pressure source is a tubing string positioned within a wellbore.

22. The hydraulic actuator system of claim 7 wherein said low pressure source is an annulus of a wellbore.

23. A wellbore system, comprising:

a wellbore; and a plurality of hydraulic actuators disposed within said wellbore, at least one of said plurality of hydraulic actuators comprising, a hydraulic fluid reservoir locatable in a downhole environment of said wellbore, a piezoelectric pump connected to said hydraulic fluid reservoir, and a hydraulically actuatable device connected to said piezoelectric pump.

24. The wellbore system of claim 23 wherein at least two hydraulic actuators of said plurality of said hydraulic actuators are in communication with each other.

25. The wellbore system of claim 23 wherein said piezoelectric pump of said hydraulic actuator is in communication with a power source.

26. The wellbore system of claim 25 wherein said communication between said piezoelectric pump and said power source is electrical communication.

27. The wellbore system of claim 25 wherein said communication between said piezoelectric pump and said power source is photo communication.

28. The wellbore system of claim 27 wherein said photo communication is through a fiber optic cable.

29. A method for controlling a remotely located hydraulic actuator, comprising:

communicating a signal from a power source to a piezoelectric pump;

pressurizing a hydraulic fluid with said piezoelectric pump; and directing said hydraulic fluid to a hydraulically actuatable device in said hydraulic actuator to bias a downhole piston, thereby translating said piston in either a first or a second direction.

30. The method for controlling the remotely located hydraulic actuator of claim 29 wherein said communicating said signal further comprises transmitting a signal to a controller configured to effectuate the pressurization and direction of said hydraulic fluid to bias said piston.

31. The method for controlling the remotely located hydraulic actuator of claim 30 wherein said transmitting of said signal is through an electrical communication medium.

32. The method for controlling the remotely located hydraulic actuator of claim 30 wherein said transmitting of said signal is through a photo communication medium.

33. The method for controlling the remotely located hydraulic actuator of claim 28 wherein said pressurizing further comprises, expanding a piezoelectric element in said piezoelectric pump, decreasing a volume of a chamber in which a hydraulic fluid is disposed, creating a high pressure condition within said volume of said chamber, and causing said hydraulic fluid to flow out of said chamber.

34. The method for controlling the remotely located hydraulic actuator of claim 29 wherein said power source is located at a location remote from said hydraulic actuator.

35. The method for controlling the remotely located hydraulic actuator of claim 34 wherein said power source is located at a well head of a wellbore and said hydraulic actuator is located in a downhole environment of said wellbore.

36. A method for controlling one or more hydraulic cylinders connected to the hydraulic actuator of claim 1, comprising:

communicating a signal from a power source to said piezoelectric pump;

pressurizing a hydraulic fluid with said piezoelectric pump; and directing said hydraulic fluid to a cylinder in said hydraulic actuator of claim 1 to bias a piston, thereby translating said cylinder in either a first or a second direction.

37. The hydraulic actuator of claim 1 wherein said hydraulic fluid reservoir and said hydraulically operable device define a closed hydraulic system.

38. The hydraulic actuator system of claim 6 further comprising a closed hydraulic fluid system.

39. The wellbore system of claim 23 wherein said hydraulic fluid reservoir is a part of a closed hydraulic fluid system.

* * * * *